US010927489B2

(12) United States Patent
Moon et al.

(10) Patent No.: US 10,927,489 B2
(45) Date of Patent: Feb. 23, 2021

(54) WASHING MACHINE AND METHOD OF CONTROLLING THE SAME

(71) Applicant: LG Electronics Inc., Seoul (KR)

(72) Inventors: Byunghyun Moon, Seoul (KR); Oshin Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 308 days.

(21) Appl. No.: 15/949,473

(22) Filed: Apr. 10, 2018

(65) Prior Publication Data

US 2018/0291547 A1 Oct. 11, 2018

(30) Foreign Application Priority Data

Apr. 10, 2017 (KR) ..... 10-2017-0046235

(51) Int. Cl.
*D06F 37/22* (2006.01)

(52) U.S. Cl.
CPC ..... *D06F 37/225* (2013.01); *D06F 2202/12* (2013.01); *D06F 2204/065* (2013.01); *D06F 2222/00* (2013.01)

(58) Field of Classification Search
None
See application file for complete search history.

(56) References Cited

U.S. PATENT DOCUMENTS 5,181,398 A * 1/1993 Tanaka ..... D06F 35/007 68/12.06
2012/0192362 A1 8/2012 Lee et al.
2012/0278996 A1* 11/2012 Park ..... D06F 37/225 8/137
2013/0327099 A1 12/2013 Bae et al.

FOREIGN PATENT DOCUMENTS

KR 1020130114478 10/2013

OTHER PUBLICATIONS

Espacenet translation KR 20130114478, Washing Machine, LG Electronics (Year: 2013).*
European Extended Search Report in European Application No. 18166495.4, dated Jun. 29, 2018, 7 pages.

* cited by examiner

*Primary Examiner* — Cristi J Tate-Sims
(74) *Attorney, Agent, or Firm* — Fish & Richardson P.C.

(57) ABSTRACT

The present invention relates to a washing machine, having an actively movable balancer, and method of controlling the same. The washing machine according to an embodiment of the present invention includes: a tub; a drum; a balancing unit moving along a circumference of the drum; and a transmission coil provided at the tub, and to generate a magnetic field and transmit power wirelessly to the balancing unit, wherein the balancing unit comprises: a reception coil to generate electric power from the magnetic field formed by the transmission coil; and a position sensing unit to sense the magnetic field formed by the transmission coil and to generate a position signal when the balancing unit passes through the transmission coil.

16 Claims, 10 Drawing Sheets

WASHING MACHINE AND METHOD OF CONTROLLING THE SAME

CROSS-REFERENCE TO RELATED APPLICATION

This application claims the priority benefit of Korean Patent Application No. 10-2017-0046235, filed on Apr. 10, 2017 in the Korean Intellectual Property Office, the disclosure of which is incorporated herein by reference.

BACKGROUND

1. Field

The present disclosure relates generally to a washing machine and a method of controlling the same and, more particularly, to a washing machine having an actively movable balancer and a method of controlling the same.

2. Description of the Related Art

Generally, a washing machine is an appliance for performing washing, rinsing, and spin-drying cycles to remove contaminants from clothing, bedding, and the like (hereinafter referred to as "laundry") by using water, detergent, and mechanical operations.

The washing machine is provided with a balancer to reduce imbalance which occurs when laundry in a drum is unevenly distributed. As the balancer used in the washing machine, a ball balancer or a liquid balancer is used. However, there is a problem that the ball balancer or the liquid balancer moves passively in response to rotation of a drum, such that as the ball balancer or the liquid balancer moves to an opposite side of the center of mass of laundry, and accordingly, the drum continuously rotates until the imbalance is reduced. In order to solve such a problem, a method of actively moving the balancer is suggested.

The actively movable balancer is controlled to move to the opposite side of the center of gravity of the laundry. It is necessary to grasp the position of the balancer in order to control the balancer, but it is difficult to grasp the position of the balancer by rotating together with the drum when the drum rotates.

SUMMARY

It is an object of the present invention to provide a washing machine capable of positively detecting a position of a movable balancer, and a method of controlling the same.

The objects of the present invention are not limited to the aforementioned objects and other objects undescribed herein will be clearly understood by those skilled in the art from the following description.

In accordance with the present invention, the above and other objects can be accomplished by providing a washing machine including: a tub containing wash water; a drum having a cylindrical shape, rotatably provided in the tub, and to accommodate laundry; a balancing unit moving along a circumference of the drum; and a transmission coil provided at the tub, and to generate a magnetic field and transmit power wirelessly to the balancing unit, wherein the balancing unit comprises: a reception coil to generate electric power from the magnetic field formed by the transmission coil; and a position sensing unit to sense the magnetic field formed by the transmission coil, and to generate a position signal when the balancing unit passes through the transmission coil. Accordingly, a position of the balancing unit may be determined.

The balancing unit may further include a receiving communication unit to transmit the position signal generated by the position sensing unit.

The washing machine may further include: a transmission communication unit which receives the position signal transmitted by a receiving communication unit; a drum motor to rotate the drum; a hall sensor which detects a rotation angle of the drum motor; and a transmission controller which determines a position of the balancing unit from the position signal and the rotation angle of the drum motor detected by the hall sensor.

The balancing unit is provided with a plurality includes a first balancing unit and a second balancing unit. The hall sensor generates a pulse signal for each set unit angle, and the transmission controller can calculate an angle between the first balancing unit and the second balancing unit by counting a number of pulse signals until the position signal generated from the second balancing unit is received after the position signal generated from the first balancing unit is received.

The position sensing unit may include: a cylindrical inductor component to generate an electromotive force from the magnetic field formed by the transmission coil; and a zener diode element to generate a position signal by adjusting the electromotive force generated by the inductor component to a constant voltage magnitude.

The inductor component may be arranged such that an upper surface of the cylindrical shape faces a surface formed by the transmission coil.

Further, in accordance with the present invention, the above and other objects can be accomplished by providing a method of controlling a washing machine, the method including: receiving a position signal generated when a first balance unit passes through a transmission coil; counting a pulse signal generated by a hall sensor detecting a rotation angle of the drum motor rotating a drum; receiving the position signal generated when the second balancing unit passes through the transmission coil; and calculating an angle between the first balancing unit and the second balancing unit by counting a number of pulse signals which are received after receipt of the position signal generated from the first balancing unit and before receipt of the position signal generated from the second balancing unit, Accordingly, a position of the balancing unit may be determined.

The hall sensor generates the pulse signal for each set unit angle, and the angle between the first balancing unit and the second balancing unit can be calculated from the number of the pulse signals and the unit angle.

The specifics of other embodiments are included in the detailed description and drawings.

Effects

The washing machine and method of controlling the same of the present disclosure have one or more of the following effects.

First, there is an advantage that it is possible to determine a relative position of a plurality of dispersion units by constructing a circuit of a simple element for detecting the magnetic field of the transmission coil.

Secondly, there is also an advantage of accurately detecting the magnetic field of the transmission coil by appropriately arranging the inductor components.

Thirdly, there is also an advantage that the relative position of a plurality of dispersion units can be determined by using a hall sensor that detects the rotation angle of the drum motor.

Fourthly, there is also an advantage that it is possible to calculate the angle between a plurality of dispersion units using the pulse signal of the hall sensor and the position signal generated by the inductor component.

Effects of the present invention should not be limited to the aforementioned effects and other unmentioned effects will be clearly understood by those skilled in the art from the claims.

DETAILED DESCRIPTION OF THE EMBODIMENTS

Figure 1:
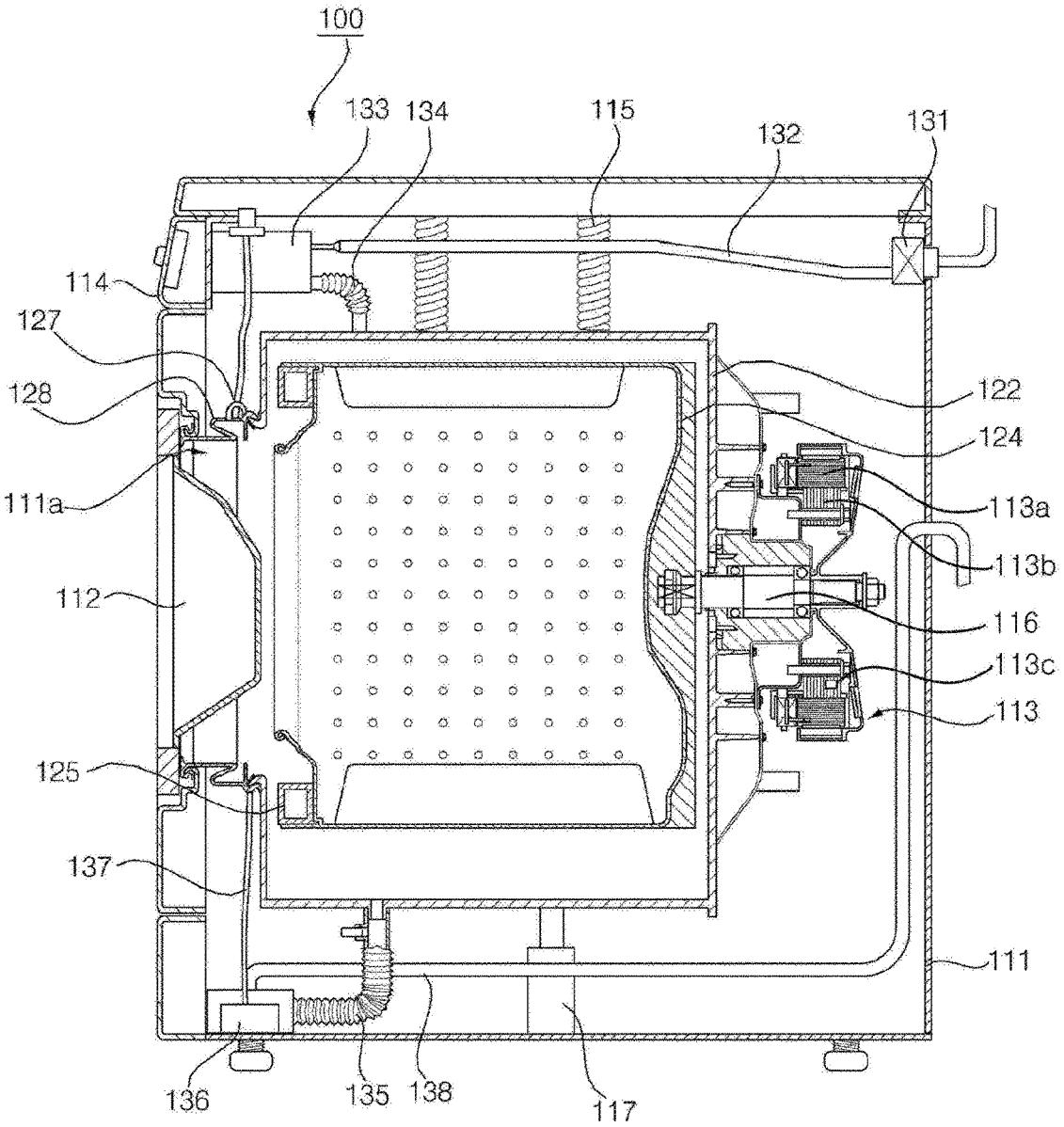
FIG. 1 is a cross-sectional view of a washing machine according to an embodiment of the present invention.

Advantages and features of the present disclosure and methods for accomplishing the same will be more clearly understood from exemplary embodiments described below with reference to the accompanying drawings. However, the present disclosure is not limited to the following embodiments, but may be implemented in various different forms. The embodiments are provided only to complete disclosure of the present disclosure and to fully provide a person having ordinary skill in the art to which the present disclosure pertains with the category of the present disclosure, and the present disclosure will be defined by the scope of the appended claims. Like reference numerals generally denote like elements through the specification.

Hereinafter, embodiments of the present disclosure will be described in detail with reference to the accompanying drawings for explaining a washing machine and a method of controlling the same.

Figure 2:
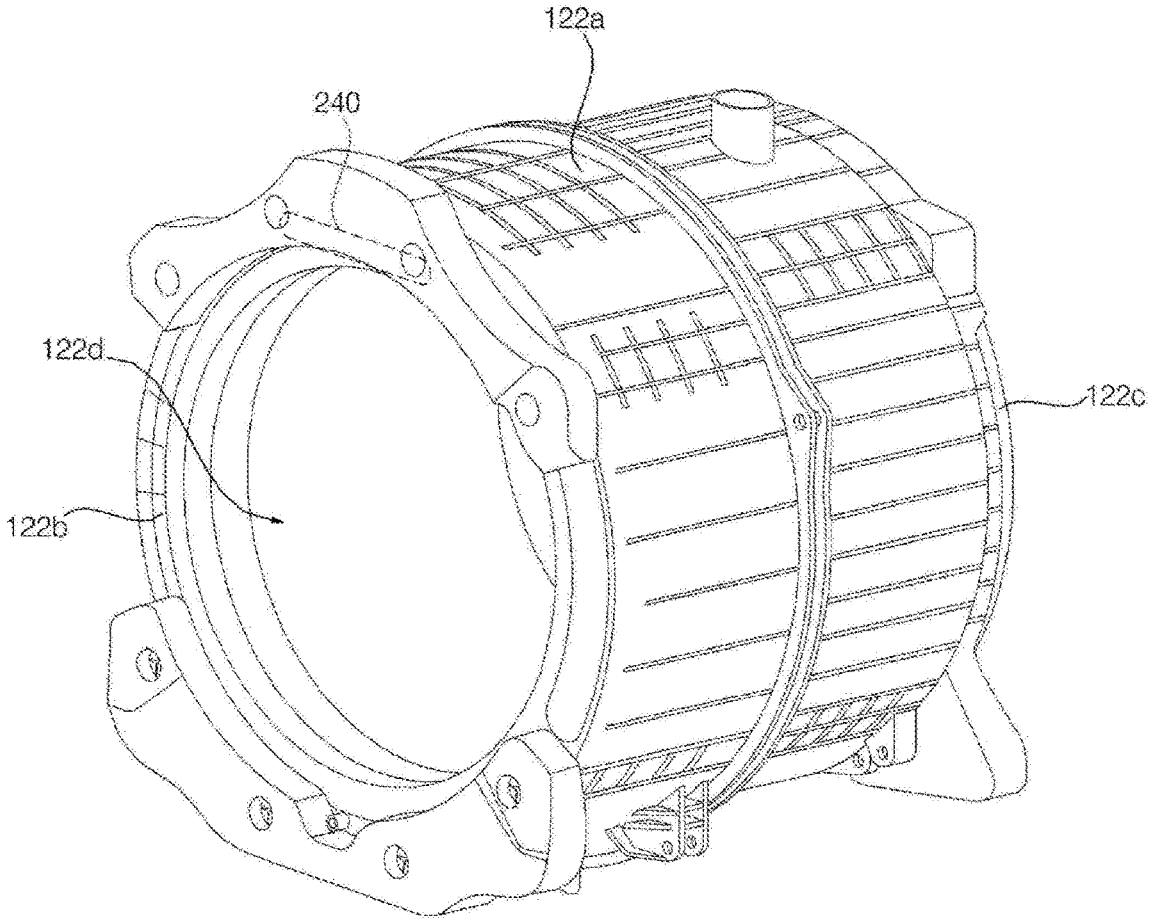
FIG. 2 is a perspective view of a tub of a washing machine according to an embodiment of the present invention.
Figure 3:
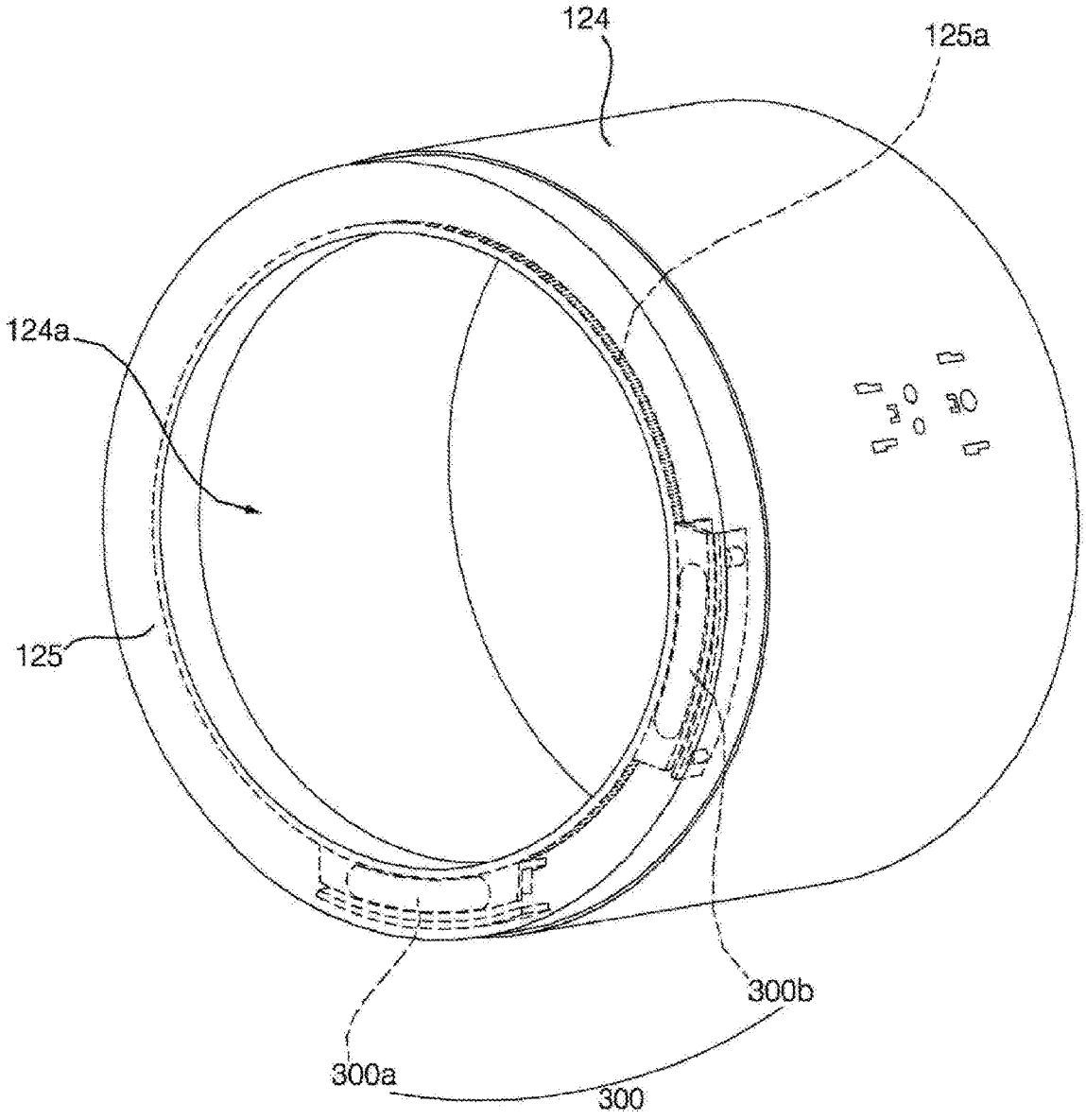
FIG. 3 is a perspective view of a drum of a washing machine according to an embodiment of the present invention.

FIG. 1 is a cross-sectional view of a washing machine according to an embodiment of the present invention; FIG. 2 is a perspective view of a tub of a washing machine according to an embodiment of the present invention; and FIG. 3 is a perspective view of a drum of a washing machine according to an embodiment of the present invention.

A washing machine 100 according to an embodiment of the present disclosure includes: a cabinet 111 which forms an external appearance of the washing machine 100; a door 112 which opens and closes one side of the cabinet 111 so that laundry may be put into the cabinet 111; a tub 122 which is provided in the cabinet 111 and supported by the cabinet 111 and in which wash water is contained; a drum 124 having a cylindrical shape, which is provided in the tub 122 and which rotates when the laundry is loaded; a drum motor 113 which provides torque to the drum 124 to rotate the drum 124; a balancing unit 300 which moves along the circumference of the drum 124 to reduce imbalance caused by unbalanced distribution of laundry leaning to one side when the drum 124 rotates; a detergent box 133 in which detergent is held; and a control panel 114 which receives a user's input and displays status of a washing machine.

The cabinet 111 is provided with a laundry inlet hole 111*a*, through which laundry is loaded into the cabinet 111. The door 112 is rotatably connected with the cabinet 111 to open and close the laundry inlet hole 111*a*. The cabinet 111 is provided with the control panel 114. The cabinet 111 is provided with the detergent box 133 which may be withdrawn therefrom.

A spring 115 and a damper 117 are provided in the cabinet 111 to absorb shock of the tub 122. The tub 122 contains wash water. The tub 122 is disposed outside the drum 124 to surround the drum 124.

The tub 122 includes: a tub main body 122*a* having a cylindrical shape and both ends which are open; a front tub cover 122*b* having a ring shape and disposed at a front side of the tub main body 122*a*; a rear tub cover 122*c* having a disc shape and disposed at a rear side of the tub main body 122*a*. Hereinafter, the front side refers to the side of the door 112, and the rear side refers to the side of the drum motor 113. A tub hole 122*d* is formed at the front tub cover 122*b*. The tub hole 122*d* is formed to communicate with the laundry inlet hole 111*a* to allow the laundry to be put into the drum 124.

The drum motor 113 is provided at the rear tub cover 122*c* to generate torque. The drum motor 113 is connected with a rotation axis 116 to rotate the drum 124. The drum motor 113 may rotate the drum 124 at various speeds and directions. The drum motor 113 includes: a stator 113*a* wound with a coil; and a rotor 113*b* which rotates by generating electromagnetic interaction with the coil.

The stator 113*a* is provided with a plurality of winded coils. The rotor 113*b* is provided with a plurality of magnets for electromagnetic interaction with the coils. The rotor 113*b* rotates by the electromagnetic interaction between the coil and the magnet, and the rotational force of the rotor 113*b* is transmitted to the drum 124 to rotate the drum 124.

The drum motor 113 is provided with a hall sensor 113*c* for detecting the rotation angle of the rotor 113*b*. The hall sensor 113*c* generates a pulse signal whenever the rotor 113*b* rotates by a set unit angle. The speed and position of the rotor 113*b* are estimated using the pulse signal generated by the hall sensor 113*c*.

The rotation axis 116 connects the drum motor 113 with the drum 124. The rotation axis 116 transfers torque of the drum motor 113 to the drum 124 to rotate the drum 124. One end of the rotation axis 116 is connected to the center of rotation at the rear side of the drum 124, and the other end of the rotation axis 116 is connected with the rotor 113*b* of the drum motor 113.

The drum 124 rotates with the laundry loaded therein. The drum 124 is disposed in the tub 122. The drum 124 is formed in a cylindrical shape and is rotatable. The drum 124 has a plurality of through-holes through which wash water may pass. The drum 124 rotates by receiving the torque of the drum motor 213.

A drum hole 124*a* is provided at a front side of the drum 124. The drum hole 124*a* is formed to communicate with the laundry inlet hole 111*a* and the tub hole 122*d* so that the laundry may put into the drum 124. A guide rail 125 is connected to a front and/or a rear circumference of the drum 124. In the embodiment, the guide rail 125 is provided on a front circumference of the drum 124.

A gasket 128 seals a space between the tub 122 and the cabinet 111. The gasket 128 is interposed between the opening of the tub 122 and the laundry inlet hole 111*a*. The gasket 128 absorbs shock which is delivered to the door 112 when the drum 124 rotates, and prevents wash water in the tub 122 from leaking to the outside. The gasket 128 may be provided with a circulation nozzle 127 which sprays wash water into the drum 124.

The detergent box 133 may hold a detergent, a fabric softener, bleach, and the like. The detergent box 133 may be retractably provided at the front surface of the cabinet 111. When wash water is supplied, the detergent in the detergent box 133 is mixed with the wash water to be introduced into the tub 122.

The cabinet 111 may include: a water supply valve 131 which adjusts introduction of the wash water supplied from an external water source; a water supply passage 132 through which the wash water, introduced into the water supply valve, flows to the detergent box 133; and a water supply pipe 134 through which the wash water, mixed with the detergent in the detergent box 133, is introduced into the tub 122.

The cabinet 111 may include: a drain pipe 135 through which the wash water in the tub 122 is drained; a pump 136 which discharges the wash water in the tub 122; a circulation passage 137 which circulates the wash water; a circulation nozzle 127 which introduces the wash water is into the drum 124; and a drain passage 138 through which the wash water is drained to the outside. In some implementations, the pump 136 may include a circulation pump and a drain pump which may be connected to the circulation passage 137 and the drain passage 138 respectively.

A plurality of balancing units 300 move along the guide rail 125 of the drum 124, to change the center of gravity of the drum 124. In this case, the center of gravity of the drum 124 does not refer to the center of mass of the drum 124 itself, but refers to a common center of gravity of objects, including the drum 124, the laundry which is loaded in the drum 124, the guide rail 125, the plurality of balancing units 300, and other elements attached to the drum 24, which rotate along with the drum 124 when the drum 124 rotates.

The plurality of balancing units 300 move along the front circumference of the drum 124, to adjust the center of gravity of the drum 124 when laundry is unevenly distributed. When the drum 124 rotates with the unbalanced laundry leaning to one side, vibration and noise are caused by imbalance, in which a geometrical center of the rotation axis 116 (the center of gravity) of the drum 124 does not coincide with a real center of gravity of the drum 124. The plurality of balancing units 300 may reduce the imbalance of the drum 124 by causing the center of gravity of the drum 124 to be close to the rotation axis 116. In this embodiment, the plurality of balancing units 300 are two units of a first balancing unit 300*a* and a second balancing unit 300*b*.

The plurality of balancing units 300 move actively along the guide rail 125. The active movement refers to movement of the plurality of balancing units 300 along the guide rail 125 by using their own power.

The guide rail 125 is a passage where the plurality of balancing units 300 move. The guide rail 125 is formed in a ring shape and is connected to a front end circumference of the drum 124.

A transmission coil 240 for wireless power transmission to the plurality of balancing units 300 is disposed at the front tub cover 122*b* and/or the rear tub cover 122*c*. In this embodiment, the transmission coil 240 is disposed at the front tub cover 122*b*. The transmission coil 240 is disposed at a position facing the guide rail 125. The transmission coil 240 wirelessly transmits power to the plurality of balancing units 300 as a coil generating a magnetic field.

The control panel 114 may include: an input unit (not shown) which receives user inputs for various operations, for example, selecting a washing course, a time required for each execution, reservation, etc.; and a display unit (not shown) which displays an operation state of the washing machine 100.

Figure 4:
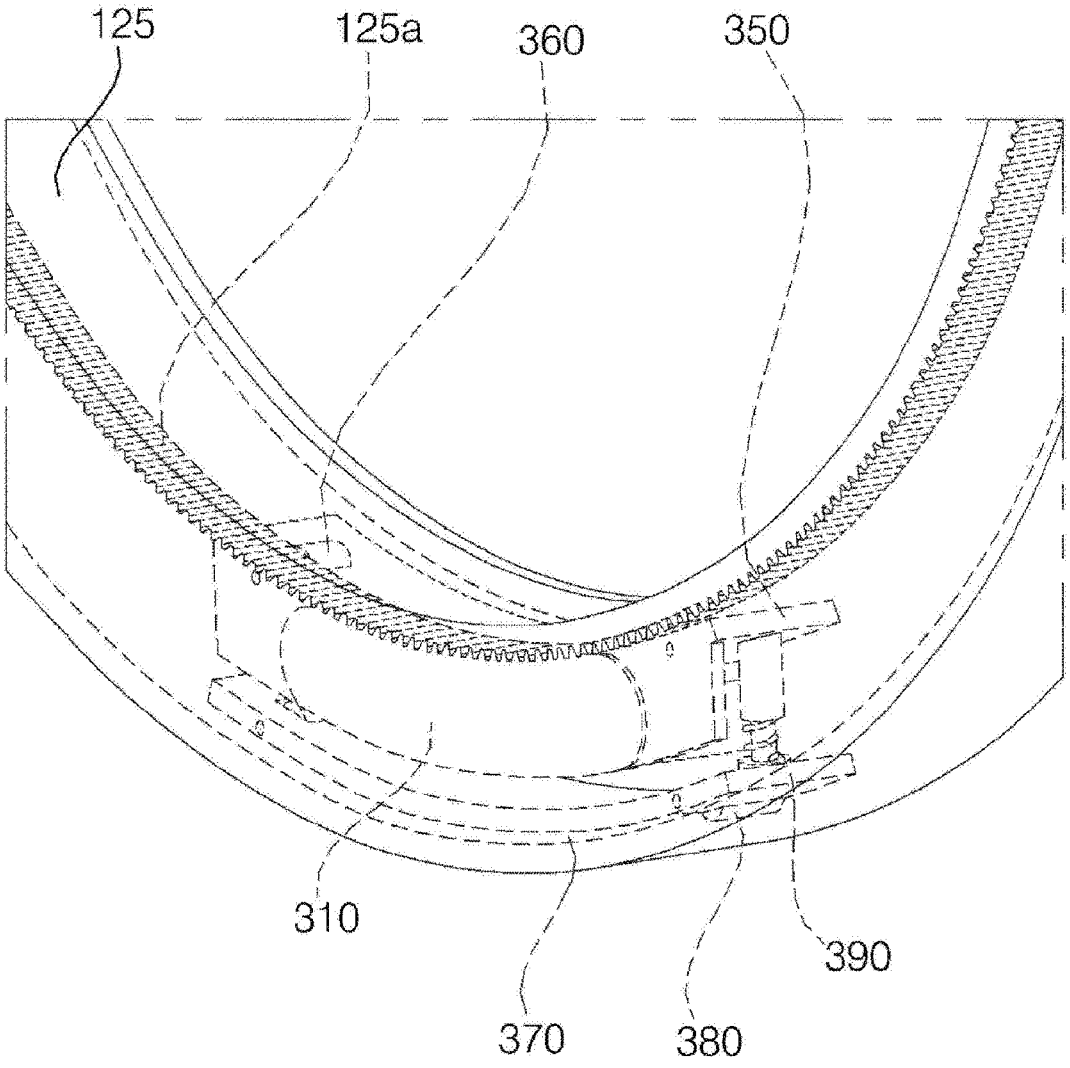
FIG. 4 is a partial perspective view of a washing machine according to an embodiment of the present invention.
Figure 5:
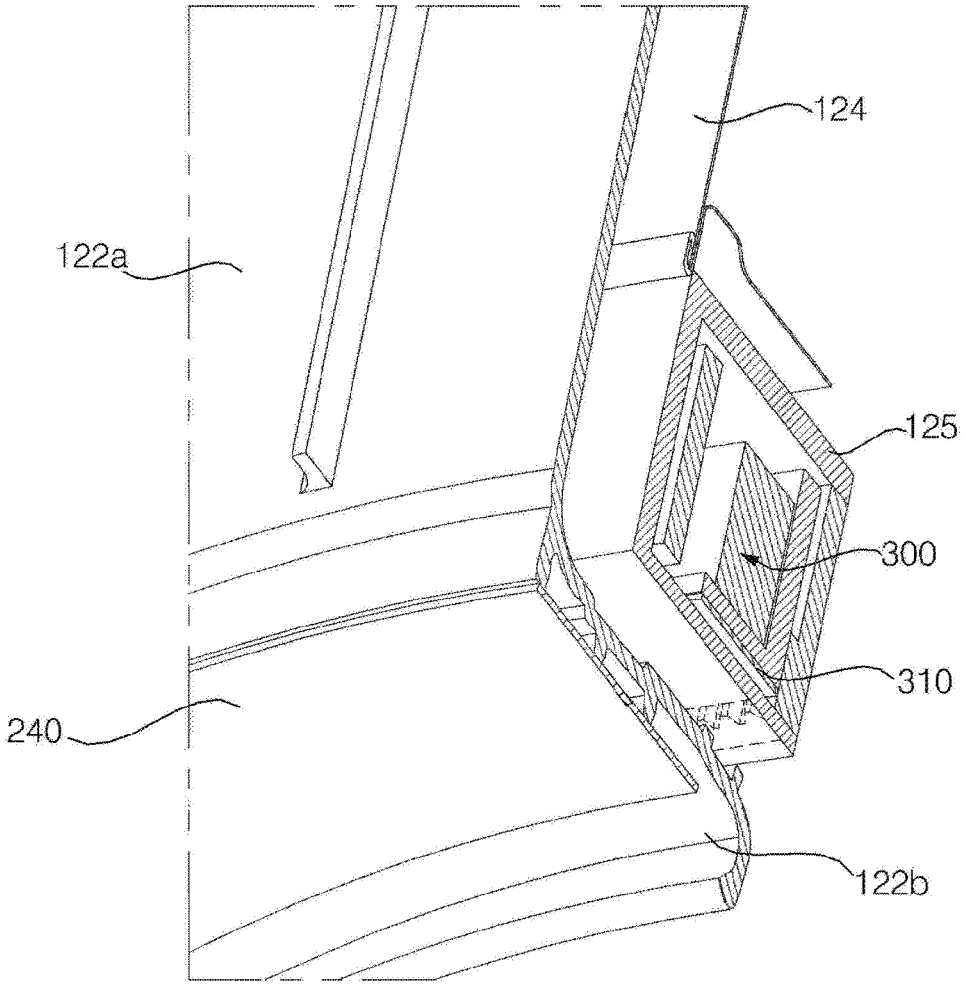
FIG. 5 is a partial cross-sectional view of a washing machine according to an embodiment of the present invention.
Figure 6:
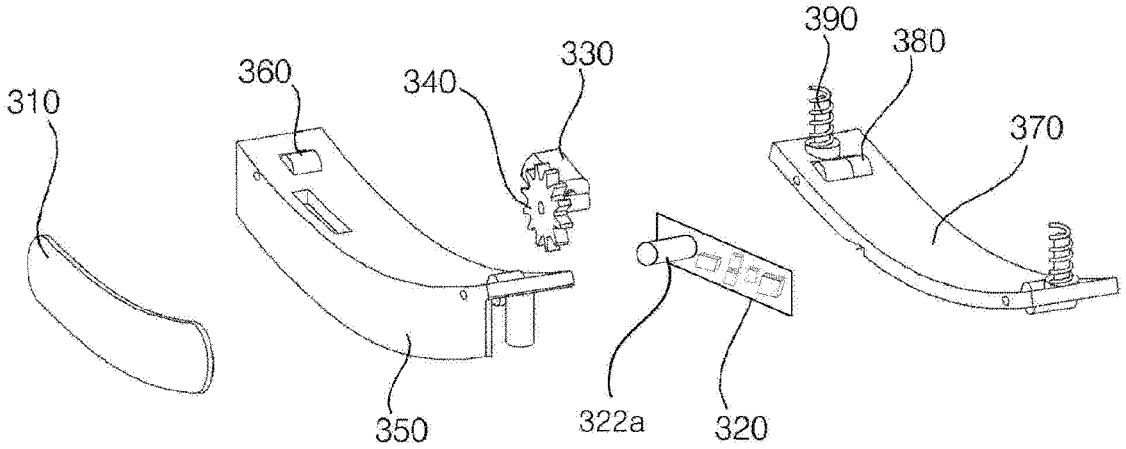
FIG. 6 is an exploded perspective view of a balancing unit of a washing machine according to an embodiment of the present invention.

FIG. 4 is a partial perspective view of a washing machine according to an embodiment of the present invention; FIG. 5 is a partial cross-sectional view of a washing machine according to an embodiment of the present invention; and FIG. 6 is an exploded perspective view of a balancing unit of a washing machine according to an embodiment of the present invention.

The balancing unit 300 according to an embodiment of the present invention includes: a reception coil 310 which generates electric power from the magnetic field formed by the transmission coil 240; a driving module 330 which generates driving power by using the electric power generated by the reception coil 310; a pinion gear 340 which rotates by receiving the driving power from the driving module 330; an upper frame 350 which includes the driving module 330 and the pinion gear 340; a lower frame 370 which is slidably connected with the upper frame 350; an elastic body 390 interposed between the upper frame 350 and the lower frame 370; and an electronic component module 320 in which electronic components are included.

The reception coil 310 generates electric power from the magnetic field formed by the transmission coil 240. The reception coil 310 is disposed on a surface that faces the tub 122 of the upper frame 350 so as to oppose the transmission coil 240. The reception coil 310 is formed as a coil which generates electric power from a magnetic field.

The driving module 330 may generate driving power by using electric power, which is supplied from an external source and transmitted wirelessly through the transmission coil 240 and the reception coil 310. The driving module 330 may be a motor which generates torque. The driving module 330 rotates the pinion gear 340. In the case where the driving module 330 is a motor, a worm gear (not shown) is interposed between the motor and the pinion gear 340 such that the worm gear rotates the pinion gear 340. The driving module 330 may be disposed at the upper frame 350.

The pinion gear 340 rotates by receiving driving power from the driving module 330. A rack gear 125*a* is disposed on an inner diameter surface of the guide rail 125; and the pinion gear 340 is engaged with the rack gear 125*a*.

The rack gear 125*a* is formed along the inner diameter surface of the guide rail 125. The cross-section of the guide rail 125 is formed in a square shape, and the inner diameter surface of the guide rail 125 refers to a surface which is located close to the center of rotation of the drum 124 among the inner side surfaces of the guide rail 125.

The pinion gear 340 rotates while being engaged with the rack gear 125*a* to actively move the balancing unit 300. As the pinion gear 340 is engaged with the rack gear 125*a*, the balancing unit 300 may be prevented from moving freely by the dead load or rotation of the drum 124.

The upper frame 350 forms the frame of the balancing unit 300. The upper frame 350 is disposed on the inner diameter surface of the guide rail 125. The upper frame 350 has a side surface which is formed in an arc shape so as to move along the guide rail 125.

The upper frame 350 includes the driving module 330, the pinion gear 340, the electronic component module 320, an upper roller 360, and the transmission coil 240. The upper frame 350 is connected with the lower frame 370, and the elastic body 390 is interposed between the upper frame 350 and the lower frame 370.

The electronic component module 320 may include various electronic components, which are provided for driving the driving module 330 by using electric power generated by the reception coil 310.

The electronic component module 320 may include an inductor component 322*a* which generates an electromotive force by a magnetic field formed by the transmission coil 240. The inductor component 322*a* is a radial type inductor component and is formed into a cylindrical shape.

The upper roller 360 is rotatably provided at the upper frame 350. The upper roller 360 may roll while being firmly pressed against the inner diameter surface of the guide rail 125. The upper roller 360 is provided to prevent the upper frame 350 from being directly in contact with the inner diameter surface of the guide rail 125. When the pinion gear 340 is engaged with the rack gear 125*a*, the upper roller 360 prevents an elastic force, provided by the elastic body 390, from being concentrated on the pinion gear 340. A plurality of upper rollers 360 may be provided.

The lower frame 370 forms a lower frame of the balancing unit 300. The lower frame 370 is disposed on an outer diameter surface of the guide rail 125. The outer diameter surface of the guide rail 125 refers to a surface that faces the inner diameter surface on the inner side of the guide rail 125. The lower frame 370 is formed in an arc shape so as to move along the guide rail 125. The lower frame 370 includes a lower roller 380.

The lower roller 380 is rotatably provided at the lower frame 370. The lower roller 380 may roll while being firmly pressed against the outer diameter surface of the guide rail 125. The lower roller 380 is provided to prevent the lower frame 370 from being directly in contact with the outer diameter surface of the guide rail 125. A plurality of lower rollers 380 may be provided.

Figure 7:
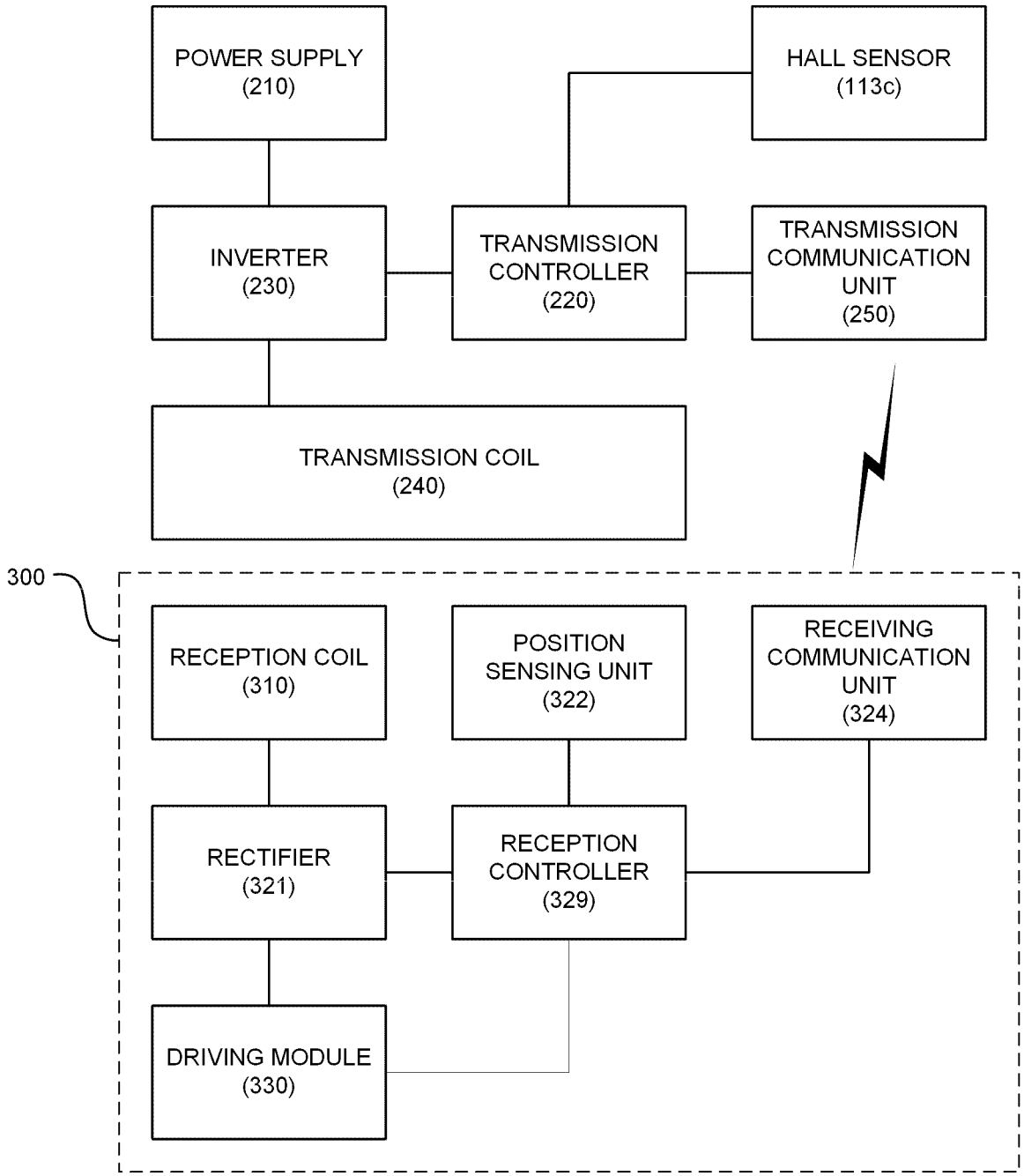
FIG. 7 is a block diagram of a washing machine according to an embodiment of the present invention.
Figure 8:
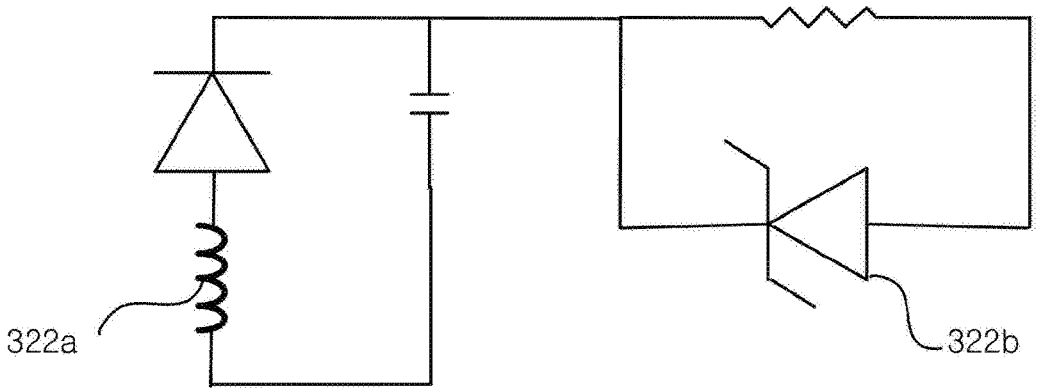
FIG. 8 is a circuit diagram of a position detecting unit of a washing machine according to an embodiment of the present invention.
Figure 9:
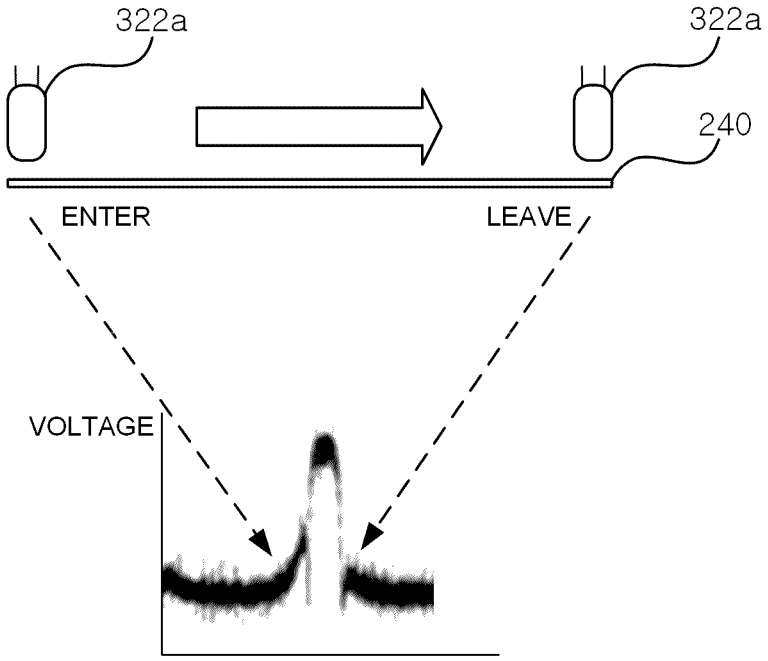
FIG. 9 is a view exemplifying generation of a position signal in the position detecting unit of the washing machine according to the embodiment of the present invention.

FIG. 7 is a block diagram of a washing machine according to an embodiment of the present invention; FIG. 8 is a circuit diagram of a position detecting unit of a washing machine according to an embodiment of the present invention; and FIG. 9 is a view exemplifying generation of a position signal in the position detecting unit of the washing machine according to the embodiment of the present invention.

The washing machine according to an embodiment of the present includes: a power supply 210 which is connected with an external power source to provide power; the aforementioned transmission coil 240 which generates a magnetic field to transmit power to the balancing unit 300 wirelessly; an inverter 230 which converts the DC input supplied from the power supply 210 into an AC waveform to apply to the transmission coil 240; a transmission communication unit 250 which receives the position signal transmitted from the balancing unit 300; and a transmission controller 220 which controls the inverter 230 and determines positions of the first balancing unit 300*a* and the second balancing unit 300*b* from the position signal received by the transmission communication unit 250 and the rotation angle of the drum motor 113 detected by the hall sensor 113*c*.

The power supply 210 converts commercial electric power, which is an alternating current supplied from an external power source, into a direct current, and supplies the direct current to the inverter 230. The power supply 210 may be provided in the cabinet 111 or at the control panel 114. The power supplied after conversion by the power supply 210 may also be supplied to the drum motor 113.

The inverter 230 includes a switching device which converts the direct current (DC) into the alternating current (AC). A driving frequency of the switching device is set by the transmission controller 220. The alternating current (AC) may drive the transmission coil 240 to form a magnetic field around the transmission coil 240.

As described above, the transmission coil 240 is disposed at the tub 122 and forms a magnetic field. The transmission coil 240 is connected with a transmitting capacitor (not shown) to form a resonance circuit. As the alternating current (AC) converted by the inverter 230 flows to the transmission coil 240, a magnetic field is formed around transmission coil 240 according to a change in current.

The transmission communication unit 250 communicates with a receiving communication unit 324 which will be described later. The transmission communication unit 250 and the receiving communication unit 324 communicate with each other through Radio Frequency (RF) or infrared rays. The transmission communication unit 250 receives the position signal of the balancing unit 300 from the receiving communication unit 324. The transmission communication unit 250 transmits, to the receiving communication unit 324, a control signal for controlling the driving module 330 of the balancing unit 300.

The transmission controller 220 controls a driving frequency of the inverter 230 so as to control a resonant frequency of the resonance circuit formed by the transmission coil 240. The transmission controller 220 receives the position signal of the balancing unit 300 from the transmission communication unit 250 and receives the pulse signal from the hall sensor 113*c* to determine the positions of the first balancing unit 300*a* and the second balancing unit 300*b*. The positions of the first balancing unit 300*a* and the second balancing unit 300*b* are changed in response to the rotation of the drum 124, and thus, such positions are positions of the first balancing unit 300*a* and the second balancing unit 300*a* relative thereto. In this embodiment, the positions of the first balancing unit 300*a* and the second balancing unit 300*b* are an angle therebetween. In this embodiment, the transmission controller 220 calculates the angle between the first balancing unit 300*a* and the second balancing unit 300*b* from the position signal of the balancing units 300 and the pulse signal of the hall sensor 113*c*. Detailed description thereof will be given later with reference to FIG. 10 and FIG. 11.

The transmission controller 220 generates a control signal to move the balancing unit 300 by a degree of imbalance of the drum 124. The degree of imbalance of the drum 124 can be measured using a vibration sensor (not shown) which senses vibration of the tub 122 or may be measured using change in the rotational speed of the drum 124, which is measured using the hall sensor 113*c*. The transmission controller 220 may move the first balancing unit 300*a* and the second balancing unit 300*b* to have a set angle therebetween, move the first balancing unit 300*a* and the second balancing unit 300*b* in the same rotational direction, or move the first balancing unit 300*a* and the second balancing unit 300*b* in different rotational directions to change an angle therebetween.

The transmission controller 220 transmits, through the receiving communication unit 324, a control signal for controlling the driving module 330 of the balancing unit 300.

The balancing unit 300 according to an embodiment of the present invention includes: a reception coil 310 which generates electric power from the magnetic field formed by the transmission coil 240; a rectifier 321 which converts the power generated in the reception coil 310 from the alternating current (AC) to the direct current (DC); a position sensing unit 322 which senses a magnetic field formed by the transmission coil 240 when passing through the transmission coil 240, to generate a position signal; and a reception controller 329 which transfers the position signal generated by the position sensing unit 322 to the receiving communication unit 324 and controls the driving module 330 by using the control signal received by the receiving communication unit 324. The rectifier 321, the position sensing unit 322, the receiving communication unit 324, and the reception controller 329 are provided in the electronic component module 320.

As described above, the reception coil 310 generates electric power from the magnetic field formed by the transmission coil 240. The reception coil 310 is connected to a receiving capacitor (not shown) to form a resonant circuit. When the reception coil 310 passes the transmission coil 240 in response to rotation of the balancing unit 300 together with the drum 124, the reception coil 310 receives a magnetic field formed by the transmission coil 240 and generates an AC waveform power.

The rectifier 321 converts the power, generated by reception coil 310, from the alternating current (AC) to the direct current (DC). The rectifier 321 includes a smoother which make the rectified current smooth and stable current.

The driving module 330 generates power by the rectified power from the rectifier 321 to move the balancing unit 300. The power rectified by the rectifier 321 may be temporarily stored in a capacitor (not shown) and then applied to the driving module 330.

The position sensing unit 322 senses a magnetic field formed by the transmission coil 240 to generate a position signal. When the position sensing unit 322 passes the transmission coil 240 in response to rotation of the balancing unit 300 together with the drum 124, the position sensing unit 322 generates a position signal.

Referring to FIGS. 8 and 9, the position sensing unit 322 includes: the inductor component 322*a* which generates an electromotive force from the magnetic field formed by the transmission coil 240; and a zener diode element 322*b* which generates a position signal by adjusting the electromotive force, generated by the inductor component 322*a*, to a constant voltage magnitude. The position sensing unit 322 may further include a diode and a capacitor for rectifying the electromotive force generated by the inductor component 322*a*.

The inductor component 322*a* is arranged such that a cylindrical upper surface thereof is arranged parallel to a surface formed by the transmission coil 240, while facing the surface formed by the transmission coil 240. When the inductor component 322*a* enters above the transmission coil 240 in response to the rotation of the drum 124, an electromotive force is generated. On the contrary, when the inductor component 322*a* leaves from the transmission coil 240, no electromotive force is generated. The zener diode element 322*b* generates a position signal by adjusting the electromotive force, which is generated between entering and leaving of the inductor component 322*a*, to a constant voltage magnitude.

The receiving communication unit 324 communicates with the transmission communication unit 250. The receiving communication unit 324 transmits the position signal of the balancing unit 300 to the transmission communication unit 250. The receiving communication unit 324 receives a control signal for controlling the driving module 330 of the balancing unit 300 from the transmission communication unit 250. The receiving communication unit 324 may transmit identification information to the position signal.

The reception controller 329 controls the rectifier 321 to regulate the voltage output from the rectifier 321. The reception controller 329 receives the control signal from the receiving communication unit 324 to control the driving module 330.

The reception controller 329 receives the position signal generated by the position sensing unit 322, and transmits the position signal to the transmission communication unit 250 through the receiving communication unit 324. The reception controller 329 may transmit the position signal generated by the position sensing unit 322 to the receiving communication unit 324 including identification information. That is, the reception controller 329 of the first balancing unit 300*a* transmits identification information indicating a position signal of the first balancing unit 300*a* to the position signal through the receiving communication unit 324, and the reception controller 329 of the second balancing unit 300*b* transmits identification information indicating a position signal of the second balancing unit 300*b* to the position signal through the receiving communication unit 324.

While the driving module 330 operates, the reception controller 329 does not transmit the position signal generated by the position sensing unit 322 through the receiving communication unit 324. Since the position of the balancing unit 300 determined by the transmission controller 220 is a relative position, the reception controller 329 does not transmit the position signal when the balancing unit 300 is moved.

Figure 10:
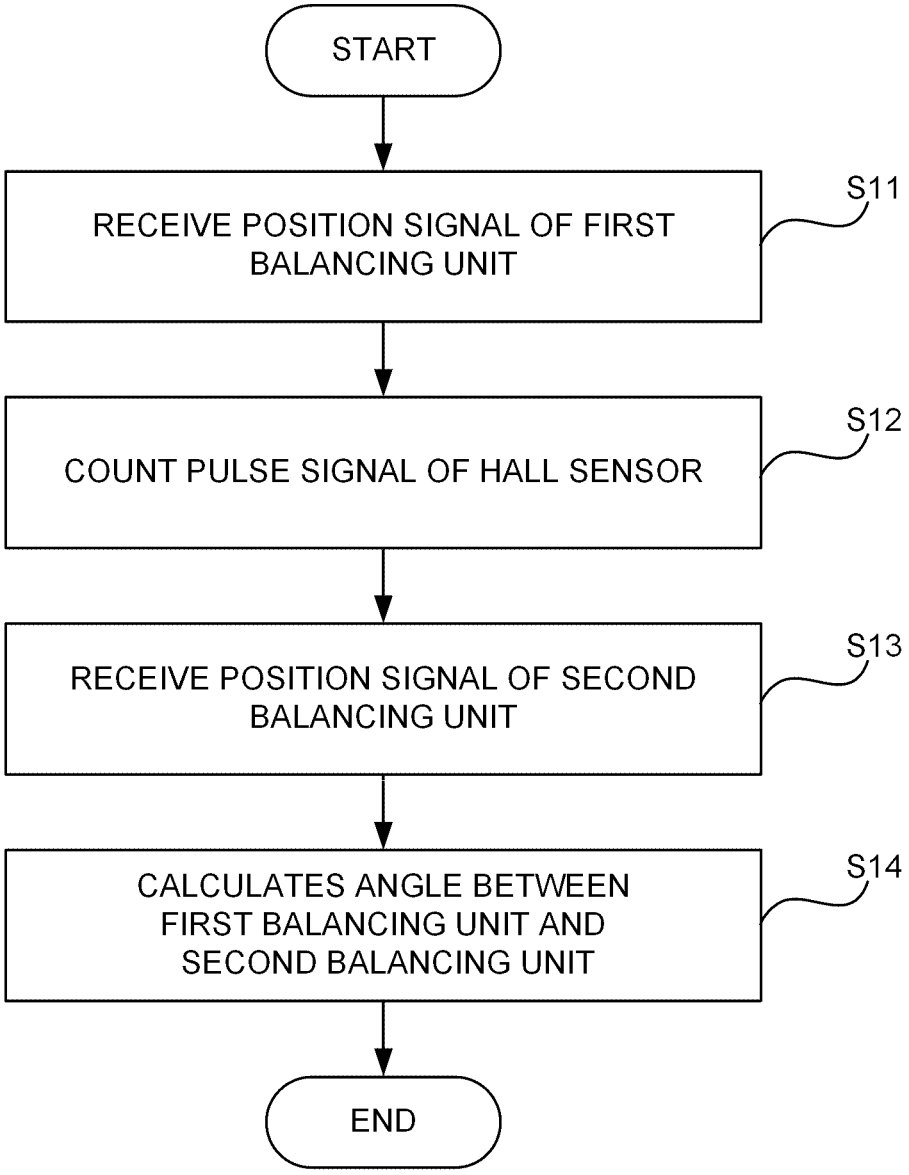
FIG. 10 is a flowchart of a method of controlling a washing machine according to an embodiment of the present invention.
Figure 11:
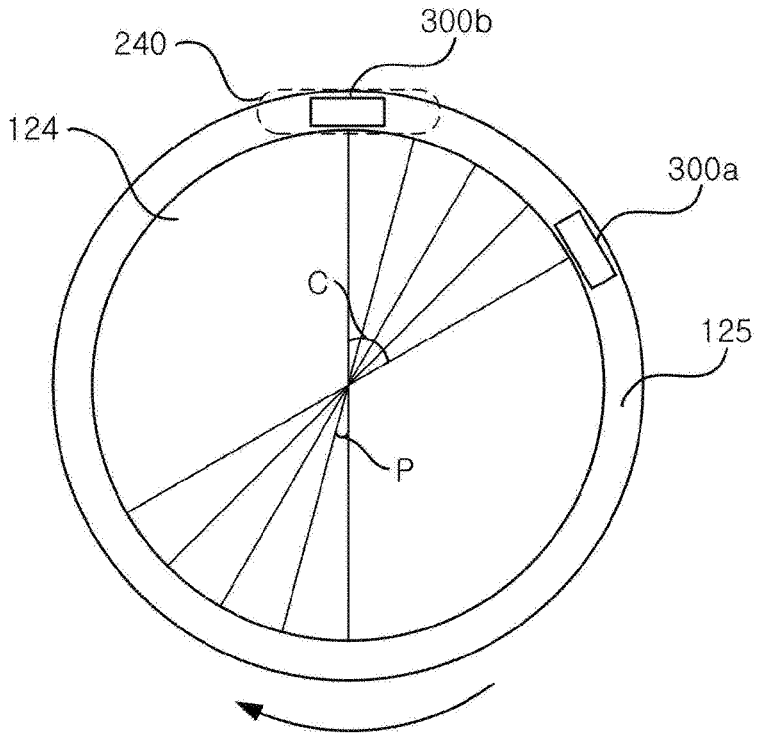
FIG. 11 is a diagram showing how to determine a position of a balancing unit of a washing machine according to the embodiment of the present invention.

FIG. 10 is a flowchart of a method of controlling a washing machine according to an embodiment of the present invention; and FIG. 11 is a diagram how to determine a position of a balancing unit of a washing machine according to the embodiment of the present invention.

The transmission controller 220 receives a position signal of the first balancing unit 300*a* through the transmission communication unit 250 (S11). Upon rotation of the drum 124, the position sensing unit 322 of the first balancing unit 300*a* generates a position signal at a time when passing through the transmission coil 240, and transmits the position signal to the reception controller 329. The reception controller 329 transmits the position signal, generated by the position sensing unit 322, through the receiving communication unit 324. The transmission communication unit 250 receives the position signal of the first balancing unit 300*a* and transmits the position signal to the transmission controller 220.

The transmission controller 220 counts the number of pulse signals generated by the hall sensor 113*c* (S12). The hall sensor 113*c* generates a pulse signal whenever the rotor 113*b* rotates by the set unit angle (P). The hall sensor 113*c* transmits the generated pulse signal to the reception controller 329 and the transmission controller 220 counts the number of the pulse signals transmitted from immediately after receiving the position signal of the first balancing unit 300*a*.

The transmission controller 220 receives the position signal of the second balancing unit 300*b* through the transmission communication unit 250 (S13). Upon rotation of the drum 124, the position sensing unit 322 of the second balancing unit 300*b* generates a position signal at a time when passing through the transmission coil 240, and transmits the position signal to the reception controller 329. The reception controller 329 transmits the position signal, generated by the position sensing unit 322, through the receiving communication unit 324. The transmission communication unit 250 receives the position signal of the second balancing unit 300*b* and transmits the position signal to the transmission controller 220.

The transmission controller 220 calculates an angle C between the first balancing unit 300*a* and the second balancing unit 300*b* (S14). The transmission controller 220 calculates the angle (C) between the first balancing unit 300*a* and the second balancing unit 300*b* by counting the number of pulse signals (S) which are received after receipt of the position signal of the first balancing unit and before receipt of the position signal of the second balancing unit.

In the case where the unit angle P and the unit of the angle (C) are on the basis of degree, the angle (C) between the first balancing unit 300*a* and the second balancing unit 300*b* is calculated as follows.

$C=(S\%(360/P))*P$ (% indicates the remainder operator)

The transmission controller 220 determines the relative positions of the first balancing unit 300*a* and the second balancing unit 300*b* by calculating the angle C between the first balancing unit 300*a* and the second balancing unit 300*b*.

While the present disclosure has been shown and described with reference to the exemplary embodiments thereof, it should be understood that the present disclosure is not limited to the specific embodiments, and various modifications and variations may be made by those skilled in the art without departing from the scope and spirit of the invention as defined by the appended claims, and the modified implementations should not be construed independently of the technical idea or prospect of the present disclosure.

What is claimed is:

1. A washing machine, comprising:

a tub configured to receive wash water;

a drum located in the tub and configured to accommodate laundry, the drum having a cylindrical shape and being configured to rotate with respect to the tub;

a balancing unit configured to move along a circumference of the drum; and a transmission coil that is located at the tub, that is configured to generate a magnetic field, and that is configured to wirelessly supply power to the balancing unit, wherein the balancing unit comprises:

a reception coil configured to generate electric power based on the magnetic field generated by the transmission coil, and a position sensing unit that is configured to sense the magnetic field generated by the transmission coil and that is configured to generate a position signal based on the balancing unit passing the transmission coil, and wherein the position sensing unit comprises:

an inductor component configured to generate electromotive force based on the magnetic field generated by the transmission coil, and a zener diode element configured to generate the position signal having a voltage magnitude corresponding to the electromotive force generated by the inductor component.

2. The washing machine of claim 1, wherein the balancing unit further comprises a receiving communication unit configured to transmit the position signal generated by the position sensing unit.

3. The washing machine of claim 1, further comprising:

a transmission communication unit configured to receive the position signal from the position sensing unit;

a drum motor configured to rotate the drum;

a hall sensor configured to detect a rotation angle of the drum motor; and a transmission controller configured to determine a position of the balancing unit at the circumference of the drum based on the position signal and the rotation angle of the drum motor.

4. The washing machine of claim 3, wherein:

the balancing unit further comprises a first balancing unit and a second balancing unit that are arranged along the circumference of the drum;

the transmission communication unit is configured to receive a first position signal from the first balancing unit and a second position signal from the second balancing unit;

the hall sensor is further configured to generate a pulse signal based on the rotation angle of the drum motor corresponding to a unit angle; and the transmission controller is further configured to:

determine a number of pulse signals that are received from the hall sensor after receipt of the first position signal and before receipt of the second position signal, and based on the number of pulse signals, determine an angle between a first extension line extending from a center of the drum to the first balancing unit and a second extension line extending from the center of the drum to the second balancing unit.

5. The washing machine of claim 1, wherein the inductor component has a cylindrical shape, and wherein an upper surface of the inductor component faces a surface of the transmission coil.

6. The washing machine of claim 3, wherein the balancing unit further comprises a receiving communication unit configured to transmit the position signal generated by the position sensing unit.

7. The washing machine of claim 4, wherein the rotation angle of the drum motor corresponds to a multiple of a unit angle, and wherein the hall sensor is further configured to generate the pulse signal based on rotation of the drum motor by the unit angle.

8. The washing machine of claim 1, wherein the voltage magnitude of the position signal is a constant value.

9. The washing machine of claim 1, wherein the balancing unit is configured to balance a weight distribution of laundry in the drum based on movement along the circumference of the drum.

10. The washing machine of claim 4, wherein the first balancing unit is configured to move along the circumference of the drum relative to the second balancing unit.

11. The washing machine of claim 4, wherein the angle between the first extension line and the second extension line corresponds to a relative position of the first balancing unit with respect to the second balancing unit at the circumference of the drum.

12. The washing machine of claim 4, wherein the first and second balancing units are configured to independently move along the circumference of the drum based on rotation of the drum.

13. The washing machine of claim 1, further comprising a guide rail that is located at a front side of the drum, that is configured to receive the balancing unit, and that is configured to guide movement of the balancing unit along the circumference of the drum, wherein the drum defines an introduction hole at the front side of the drum, the introduction hole being configured to receive laundry.

14. The washing machine of claim 13, wherein the transmission coil faces toward the guide rail.

15. The washing machine of claim 1, further comprising a guide rail that is located at a rear side of the drum, that is configured to receive the balancing unit, and that is configured to guide movement of the balancing unit along the circumference of the drum, wherein the drum defines an introduction hole at a front side of the drum opposite to the rear side, the introduction hole being configured to receive laundry.

16. The washing machine of claim 15, wherein the transmission coil faces toward the guide rail.

* * * * *